US006928795B1

(12) United States Patent
Wilson et al.

(10) Patent No.: US 6,928,795 B1
(45) Date of Patent: Aug. 16, 2005

(54) APPARATUS AND METHOD FOR LOADING A CONTAINER WITH OBJECTS

(75) Inventors: James Wilson, Pitmedden (GB); Bodo Hardt, Methlick (GB)

(73) Assignee: Project Support Engineering Limited, Inverurie (GB)

( * ) Notice: Subject to any disclaimer, the term of this patent is extended or adjusted under 35 U.S.C. 154(b) by 0 days.

(21) Appl. No.: 10/110,451

(22) PCT Filed: Oct. 11, 2000

(86) PCT No.: PCT/GB00/03895

§ 371 (c)(1),
(2), (4) Date: Aug. 26, 2002

(87) PCT Pub. No.: WO01/26969

PCT Pub. Date: Apr. 19, 2001

(30) Foreign Application Priority Data

Oct. 11, 1999 (GB) ..... 9923969
Feb. 26, 2000 (GB) ..... 0004525

(51) Int. Cl.[7] ..... B65B 1/04

(52) U.S. Cl. ..... 53/473; 53/475; 53/244

(58) Field of Search ..... 53/244, 245, 247, 53/443, 473, 475

(56) References Cited

U.S. PATENT DOCUMENTS

| | | | | |
|---|---|---|---|---|
| 3,672,118 | A * | 6/1972 | De Jong et al. | 53/501 |
| 4,367,619 | A * | 1/1983 | Lorsch | 53/245 |
| 4,870,803 | A | 10/1989 | Blumle | 53/447 |
| 4,879,862 | A | 11/1989 | Nolte et al. | 53/438 |
| 5,558,614 | A | 9/1996 | Anderson et al. | 53/468 |
| 5,611,193 | A * | 3/1997 | Farrelly | 53/475 |
| 5,732,536 | A * | 3/1998 | Lin et al. | 53/535 |

FOREIGN PATENT DOCUMENTS

| | | | |
|---|---|---|---|
| EP | 0 936 145 | 2/1999 | B65B 25/14 |
| FR | 2618750 | 7/1987 | B65B 25/14 |

* cited by examiner

*Primary Examiner*—Eugene Kim
(74) *Attorney, Agent, or Firm*—Drinker Biddle & Reath LLP

(57) ABSTRACT

A grabbing member comprises at least two moveable grabbing arms which are moveable from a first configuration to a second configuration. The arms are moved toward one another from the first configuration to a second configuration such that the arms are capable of grabbing the item which may be a bundle of envelopes, books or other printed materials. A movement mechanism is provided such that the grabbing member is capable of moving the items from outwith a container or box to inside the box. A box closure apparatus is also provided for closing at least two lids of a box about an opening of the box. A work station comprising a viewing means which is arranged to permit 360 degrees of viewing area of envelopes to an operator is also provided.

19 Claims, 10 Drawing Sheets

2
22
24
22
20
22
21
23

5
9
9A
12
12A
12B
14
13
13A
13B
42
44

APPARATUS AND METHOD FOR LOADING A CONTAINER WITH OBJECTS

The present invention relates to an apparatus and method for loading objects or handling items, and also relates to an apparatus and method for closing a box, and particularly but not exclusively relates to an apparatus and method for loading objects or handling items such as envelopes, books and the like, and inserting these items into a box.

Conventionally, there are two main methods for inserting batches of envelopes into boxes such that the envelopes can be transported from the location of manufacture to distributors and/or direct to end users of envelopes.

The first method involves an operator manually picking up a batch of envelopes, such as 500, and manually rotating the envelopes in the operator's hands through 180° to inspect the envelopes for any faults. If the operator does not locate any faults in the batch of 500 envelopes, then the operator places this batch into a box. The rotation of the envelopes by the operator raises health and safety concerns since an operator may repeat this rotation exercise many hundreds of times in a day, thereby increasing the likelihood of repetitive strain injury (RSI) occurring. This can cause obvious health problems to the operator, and can lead to compensation claims being made against the envelope manufacturer. Thereafter, the operator is required to close the box, and this involves folding two end flaps of the box about their hinges over the two end flaps and open end of the box, and thereafter the operator folds two side flaps about their hinges over the open end of the box. The operator then pushes the box through a taping machine which applies tape onto the top two side flaps of the box.

A second and more mechanised method involves the use of a machine which folds a box around a batch of envelopes. It is unknown to the applicants whether it is possible to use this machine to inspect the envelopes. In addition, the use of this machine necessitates the purchase, by the manufacturer of the envelopes, specially pre-cut cardboard which is then folded by the machine to form the box around the envelopes. Accordingly, this method can prove relatively expensive to a manufacturer of envelopes. In addition, the capital cost of each machine is relatively high.

According to a first aspect of the present invention there is provided an apparatus for handling items and thereafter placing the items in a container, the apparatus comprising a grabbing member, the grabbing member comprising at least two moveable grabbing arms, the arms being moveable from a first configuration to a second configuration, the arms being moved toward one another from the first configuration to the second configuration such that the arms are capable of grabbing the item, the grabbing member having a movement mechanism associated therewith such that the grabbing member is capable of moving the items from a location outwith the container to a location inside the container.

According to a second aspect of the present invention there is provided a method of handling items and thereafter placing the items in a container, the method comprising:—

- providing a grabbing member, the grabbing member comprising at least two moveable grabbing arms;
- moving the grabbing arms toward one another to grab the items;
- moving the grabbing member such that the grabbing member moves the items from a location outwith the container to a location inside the container.

Typically, the items are envelopes, and typically the container is a box formed from a suitable material such as cardboard.

Preferably, the movement mechanism is capable of moving the grabbing member in a horizontal plane, and the movement mechanism is preferably capable of moving the grabbing mechanism in a vertical plane. Most preferably, the movement mechanism is capable of moving the grabbing mechanism in both a horizontal and a vertical plane.

The movement mechanism preferably comprises a horizontal movement device and preferably also comprises a vertical movement device. Typically, the horizontal movement device comprises a horizontally arranged track, and a horizontal movement mechanism which acts between the track and the grabbing member. Preferably, the horizontal movement mechanism is a piston which is typically operable by means of a control system.

Typically, the vertical movement mechanism comprises a first portion of the grabbing member and a second portion of the grabbing member, the first and second portions being moveable relative to one another by means of a vertical movement mechanism. Preferably, the vertical movement mechanism is a piston which acts, and is operable between, the first and second portions of the grabbing member.

Preferably, the first portion of the grabbing mechanism is movably coupled to, and preferably slung from, the track, and the second portion is typically coupled to the grabbing arms, where the first and second portions are typically coupled to one another by means of the piston.

Preferably, the grabbing arms are moveable toward one another by means of an arm movement mechanism, wherein the arm movement mechanism is preferably capable of moving the arms both toward one another and also away from one another. Preferably, the arm movement mechanism typically comprises a piston.

According to a third aspect of the present invention there is provided a box closure apparatus, the box having at least two lid portions arranged on the box about an opening of the box, where the lid portions are coupled to the box by respective hinges and are capable of being moved about their respective hinges into a configuration such that the opening of the box is substantially closed, the apparatus comprising first and second members having respective contact surfaces, the respective contact surfaces being adapted to move the respective lid portions about their respective hinges into the said configuration upon relative movement between the first and second members and the box.

According to a fourth aspect of the present invention there is provided a method of closing a box, the box having at least two lid portions arranged on the box about an opening of the box, where the lid portions are coupled to the box by respective hinges and are capable of being moved about their respective hinges into a configuration such that the opening of the box is substantially closed, the method comprising providing first and second members having respective contact surfaces, and causing relative movement between the first and second members and the box, such that the respective contact surfaces move the respective lid portions about their respective hinges into the said configuration.

Typically, the first and second members each have at least two contact surfaces. The first and second members are typically first and second arms, each arm having a first and second end, and the arms being angled outwardly from one another such that the first end of each respective arm is closer to one another than the second end of each respective arm. Preferably, the pair of arm ends farthest apart from one another (the said first ends) is the pair of arm ends first in contact with the lid portions of the box.

Typically, the arms are inclined to the horizontal axis such that one end of each respective arm is vertically higher than the other end of each respective arm. Preferably, the vertically lowermost pair of arm ends is the said first arm ends.

Typically, the first contact surface is provided on the uppermost surface of first arm end, whereby the first contact surface is arranged to make contact with the outermost surface of the respective lid portion prior to the respective lid portion being moved about it's hinge until the respective lid portion is upstanding vertically; for the sake of clarity, outermost being relative to the interior of the box.

Preferably, the second contact surface is provided on a lowermost surface of the arm and is arranged to make contact with the outermost surface of the respective lid portion from the vertically upstanding configuration of the respective lid portion until the respective lid portion has reached the substantially closed configuration of the opening of the box.

Typically, where the box is provided with a third lid portion, where the third lid portion is coupled to the box by a hinge and the third lid portion is capable of being moved about it's hinge into a configuration such that the opening of the box is substantially closed, a third member is provided and comprises a contact surface, such that relative movement between the third member and the box results in the contact surface of the third member moving the third lid portion about it's hinge into the said configuration.

The third member is typically a third arm.

Typically, the contact surface of the third arm is arranged to make contact with the outermost surface of the third lid portion at least from a vertically upstanding configuration of the third lid portion until the third lid portion has reached the substantially closed configuration of the opening of the box. Preferably, the apparatus is arranged such that the third lid portion is moved into the closed configuration of the box prior to the first and second lid portions being moved into the closed configuration of the box.

Typically, where the box is provided with a fourth lid portion, and where the fourth lid portion is coupled to the box by a hinge and the fourth-lid portion is capable of being moved about it's hinge into a configuration such that the opening of the box is substantially closed, a fourth member is provided and comprises a contact surface, such that relative movement between the fourth member and the box results in the contact surface of the fourth member moving the fourth lid portion about it's hinge into the said configuration.

Typically, the contact surface of the fourth arm is arranged to make contact with the outermost surface of the fourth lid portion at least from a vertically upstanding configuration of the fourth lid portion until the fourth lid portion has reached the substantially closed configuration of the opening of the box. Preferably, the apparatus is arranged such that the fourth lid portion is moved into the closed configuration of the box prior to the first and second lid portions being moved into the closed configuration of the box.

The fourth member is typically a moveable fourth arm, and preferably, the fourth arm is moveable relative to the first and/or second and/or third arms. Preferably, the first, second and third arms are all in a fixed relationship with respect to one another. Typically, the fourth arm is provided with a movement mechanism, and preferably, the movement mechanism is also capable of moving the box relative to the first, second and third arms. Preferably, the first, second and third arms are arranged such that once the respective lid portions are in the said substantially closed configurations, the respective arms do not substantially impede further movement of the box by means of the movement mechanism.

According to a fifth aspect the present invention provides an apparatus for observing envelopes, the apparatus comprising a work station, the work station comprising a viewing means which is arranged to permit in the region of 180 degrees of viewing area of the envelopes to an operator, the operator being able to view in the region of the other 180 degrees of viewing area, such that the operator is provided with in the region of 360 degrees of viewing area of the envelopes.

This aspect of the invention provides the advantage that the operator is not required to manually rotate the envelopes in order to check them for quality purposes, and hence the likelihood of RSI occurring to the operator is substantially reduced.

According to a sixth aspect the present invention provides a card insertion apparatus, the apparatus comprising a card movement mechanism which, when actuated, is adapted to move a card from a first location to a second location, and a biasing means which is capable of urging the card toward the first location.

Preferably, the card movement mechanism comprises a cylinder mechanism and may further comprise a card grasping means. Preferably, the card insertion apparatus further comprises a frame for at least temporarily storing the cards, and further comprises a stationary plate against which the cards are urged by the urging means.

In a preferred embodiment, the urging means comprises a mass or a weight which is coupled to a moveable member, whereby the weight urges the moveable member in the direction toward the stationary plate, thereby urging the cards toward the stationary plate.

Typically, the viewing means may be a mirror, or could be a camera and a viewing screen coupled to the camera.

Figures 3, 4:
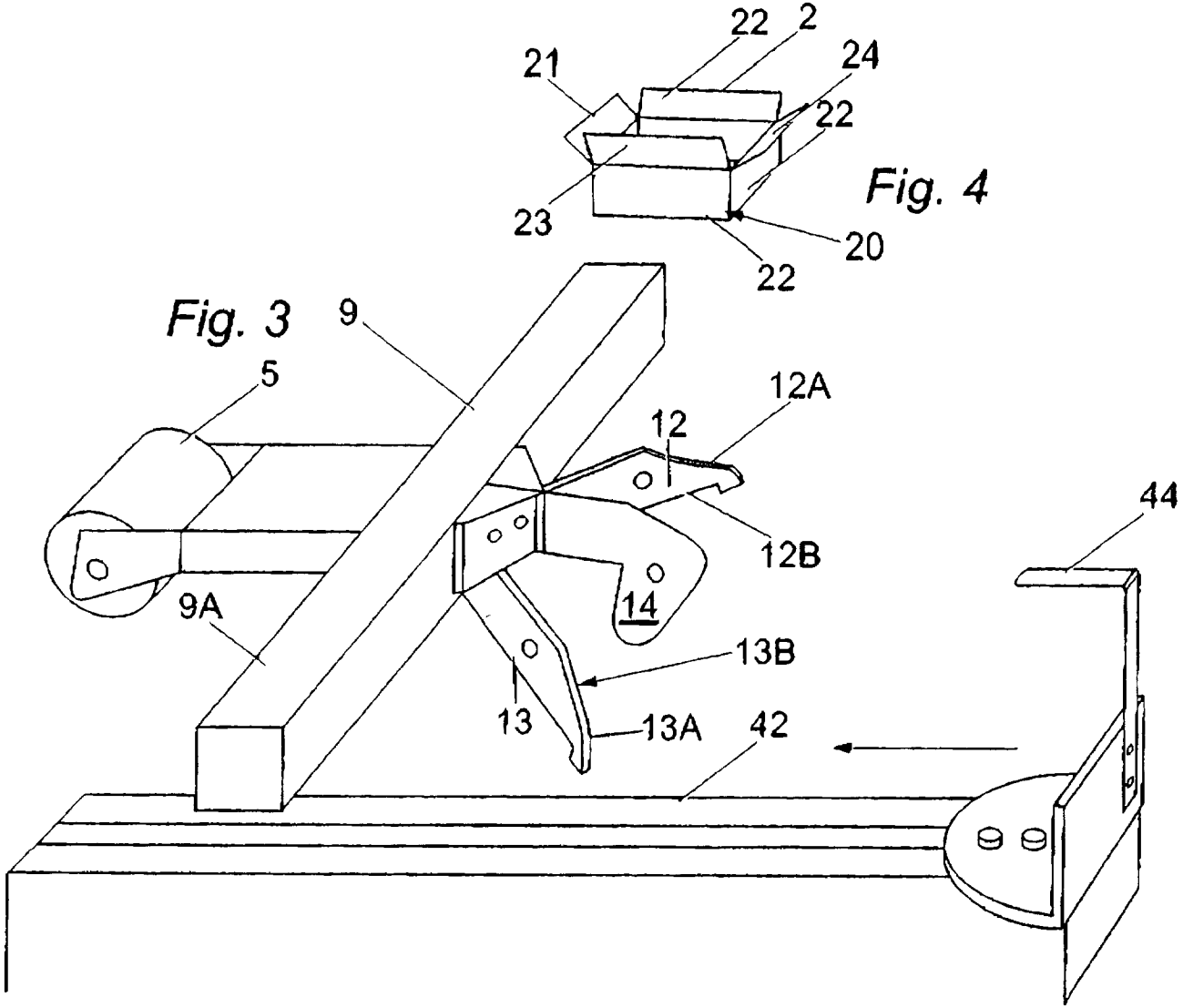
FIG. 3 is a box closure apparatus in accordance with the third aspect of the present invention and which is also incorporated into the apparatus of FIG. 1.
FIG. 4 is a perspective view of a conventional box for use with the apparatus of FIGS. 1 to 3.

Referring firstly to FIG. 4, there is shown a conventional box 20, typically formed of cardboard, which is used by manufacturers of envelopes to transport the envelopes from the point of manufacture to distributors and/or final users of the envelopes. This conventional box 20 comprises a base (not shown), four side walls 25 and four lid portions 21, 22, 23 and 24. The box 20 is normally closed by the two end lid portions 21, 24 being folded inwardly about their respective hinges such that they are horizontal, and the two side lid portions 22, 23 are then folded inwardly such that they are also horizontal and lie over the two end lids 21, 24. The respective edges of the two side lids 22, 23 are normally taped together to securely close the box 20.

Figure 1:
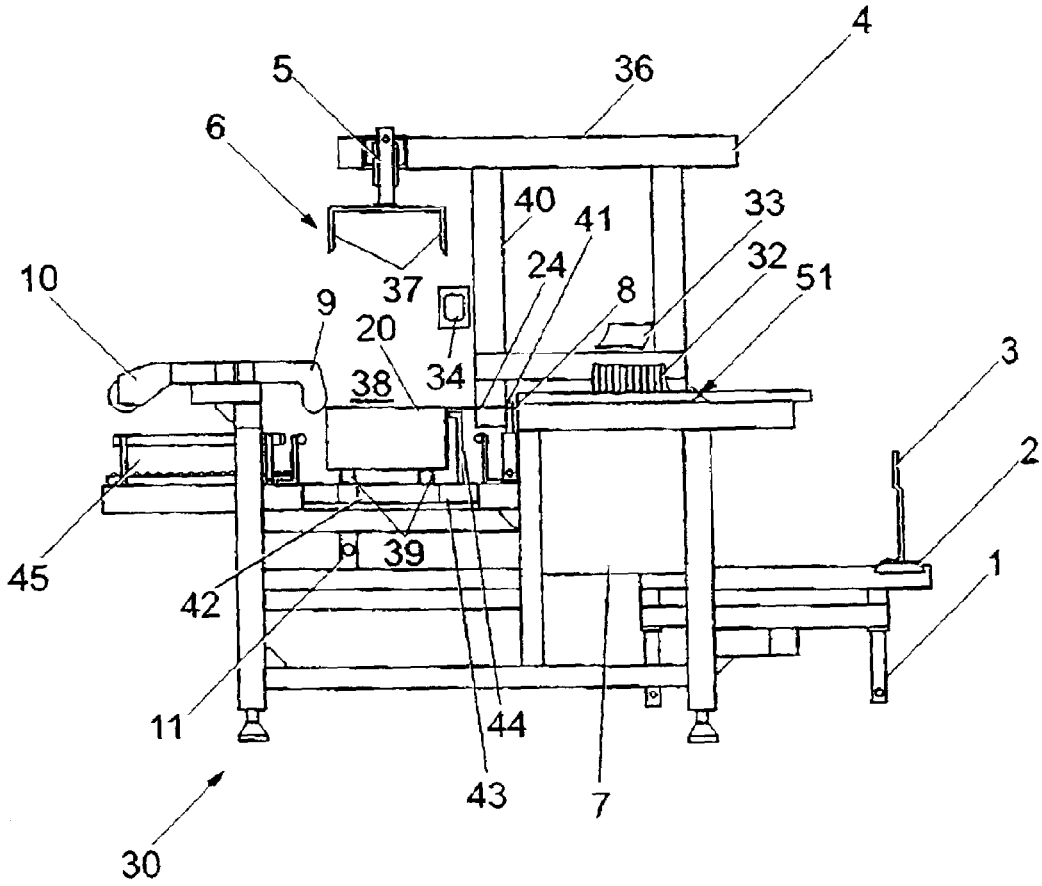
FIG. 1 is a front elevation of an apparatus for handling items, box closure apparatus and an apparatus for observing envelopes in accordance with the first, third and fifth aspects of the present invention.

Referring now to FIG. 1, there is shown a machine 30 which performs a variety of roles as will be detailed subsequently, in accordance with the various aspects of the invention.

Looking at the machine 30 as shown in FIG. 1, envelopes (not shown) are conveyed from right to left by a conveyor (not shown) such that the envelopes arrive onto an envelope loading area 32, generally designated at 32. The envelopes are stacked closely together on the envelope loading area, and the envelope forming machine (not shown) which supplies the conveyor has a counter provided therewith, such that when a predetermined number of envelopes have been supplied onto the conveyor, such as 100 or 500 envelopes, the counter instructs a control system (not shown) provided with the machine 30. The control system then actuates piston 1 which moves an envelope divider 3 vertically upwards, such that the envelope divider 3 divides the counted envelopes (i.e. the envelopes to the left hand side of the envelope divider 3) from the envelopes remaining in the conveyor. A second and horizontally arranged piston 2 is then instructed by the control system to move the envelope divider 3 and hence the counted envelopes from right to left until the envelopes are located as shown in FIG. 1 at the envelope loading area 32. The envelope loading area 32 has a glass or Perspex table top provided therewith with a suitable slot to allow for movement of the envelope divider 3. An upwardly viewing camera 7 is also provided below the glass or Perspex table top, where the camera 7 is coupled to a TV monitor 34 which permits an operator (not shown) to view the quality of the envelopes below the Perspex table. A mirror 33 is also provided which permits the operator to view the hidden end of the envelopes. Thus, an operator has a 360° viewing area of the envelopes, and is not required to manually rotate the envelopes to review them for any defects.

Figure 2:
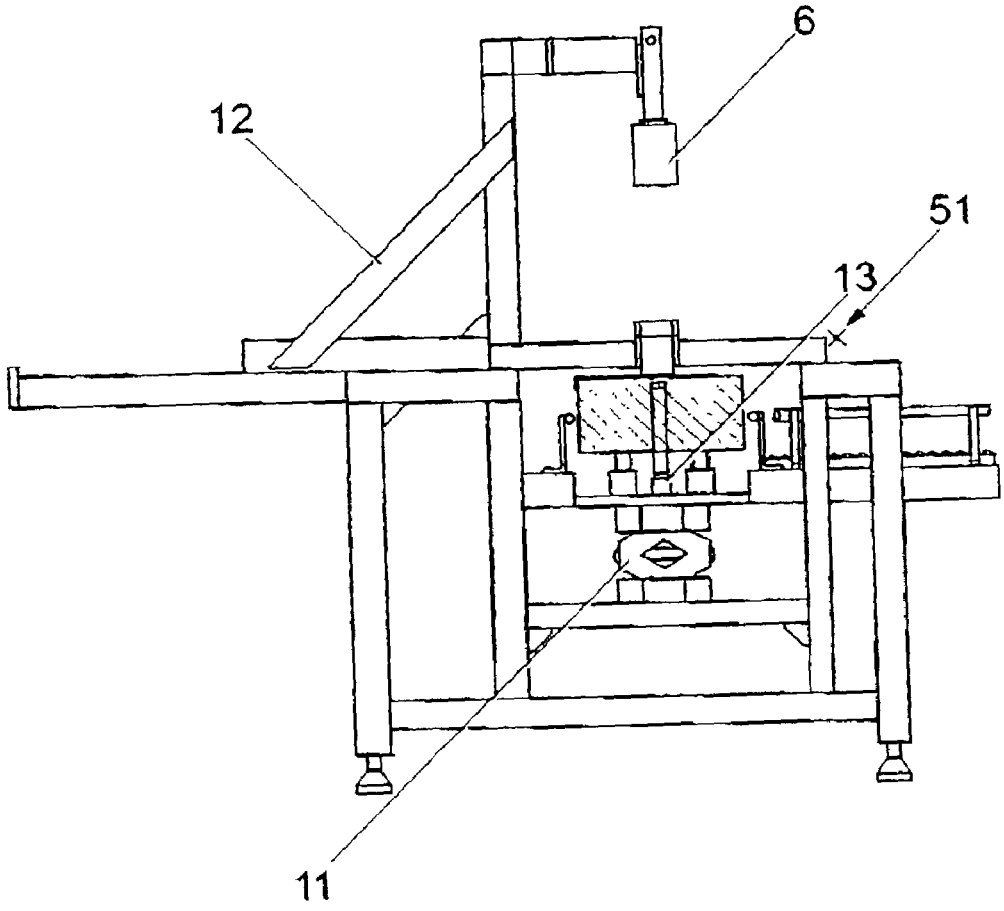
FIG. 2 is an end elevation of the apparatus of FIG. 1.
Figure 5:
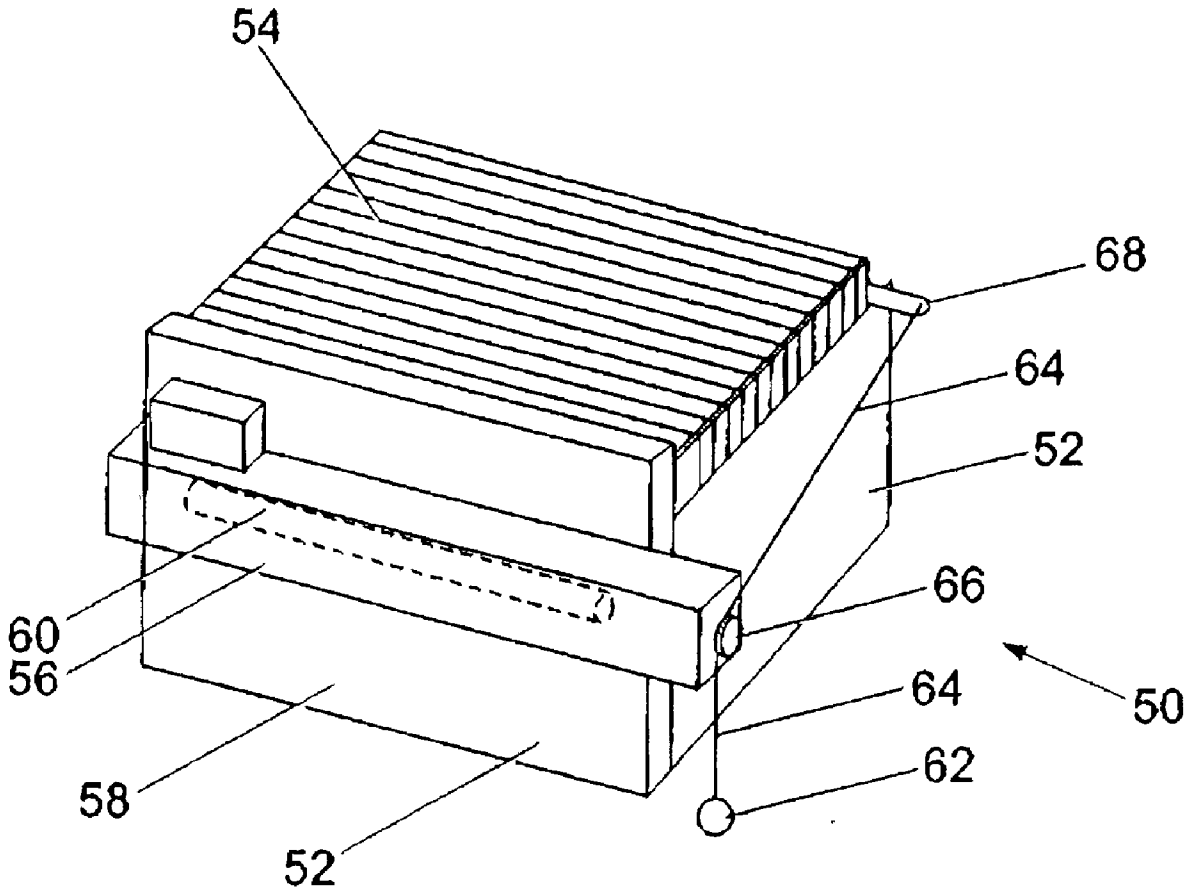
FIG. 5 is a perspective view of a first embodiment of a card insertion apparatus for use with the apparatus of FIGS. 1 to 4.

It should be noted that when envelopes are boxed for transportation and/or storage, they are placed into the box in batches of e.g. 100 or 500 envelopes, and that it is conventional to place a piece of strengthened card or cardboard at each end of the batch of envelopes in order to avoid crushing or other damage occurring to the envelopes. Hence, the card at each end of the batch of envelopes provides support and strength to that batch of envelopes. In this regard, a preferred embodiment of a card insertion unit for use with the apparatus of FIG. 1 is shown in FIG. 5 and is generally designated by the reference numeral 50. This preferred card insertion unit 50 comprises a frame 52 into which a stack of cards 54 is placed. The card insertion unit 50 is located approximately at location 51 shown on FIG. 1 and FIG. 2 in relation to the machine 30, such that the card insertion unit 50 is located to the side of, and just prior to, the envelope loading area 32. Hence, the frame 52 of the card insertion unit 50 does not obstruct the path of travel of the envelopes.

The card insertion unit 50 further comprises a rodless cylinder 56 which is horizontally mounted on a vertically upstanding stationary plate 58. A horizontal slot 60 is formed through the stationary plate 58, and a catch (not shown), which is coupled to a moveable piston of the rodless cylinder 60, projects through the horizontal slot 60, such that when the rodless cylinder 56 is actuated, the catch (not shown) moves from right to left as shown in FIG. 5 to engage a single card to pull the card in the direction right to left as shown in FIG. 5. It should be noted that the axial extent of projection of the catch through the slot 60 is less than the thickness of one card. Hence, one card is moved into the path of the next batch of envelopes. The control system controls the actuation of the rodless cylinder 60 such that a card is inserted into the path of travel for each batch of envelopes.

The cards 54 are urged toward the stationary plate 58 by means of a weight 62, pulley 64, roller 66 and backboard 68 arrangement, where one end of the pulley 64 is coupled to the weight 62 and the other end of the pulley 64 is coupled to the backboard 68. Hence, the weight 62 acts to pull the backboard 68 toward the stationary plate 58, and hence urges or biases the cards 54 toward the stationary plate 58.

Figure 6:
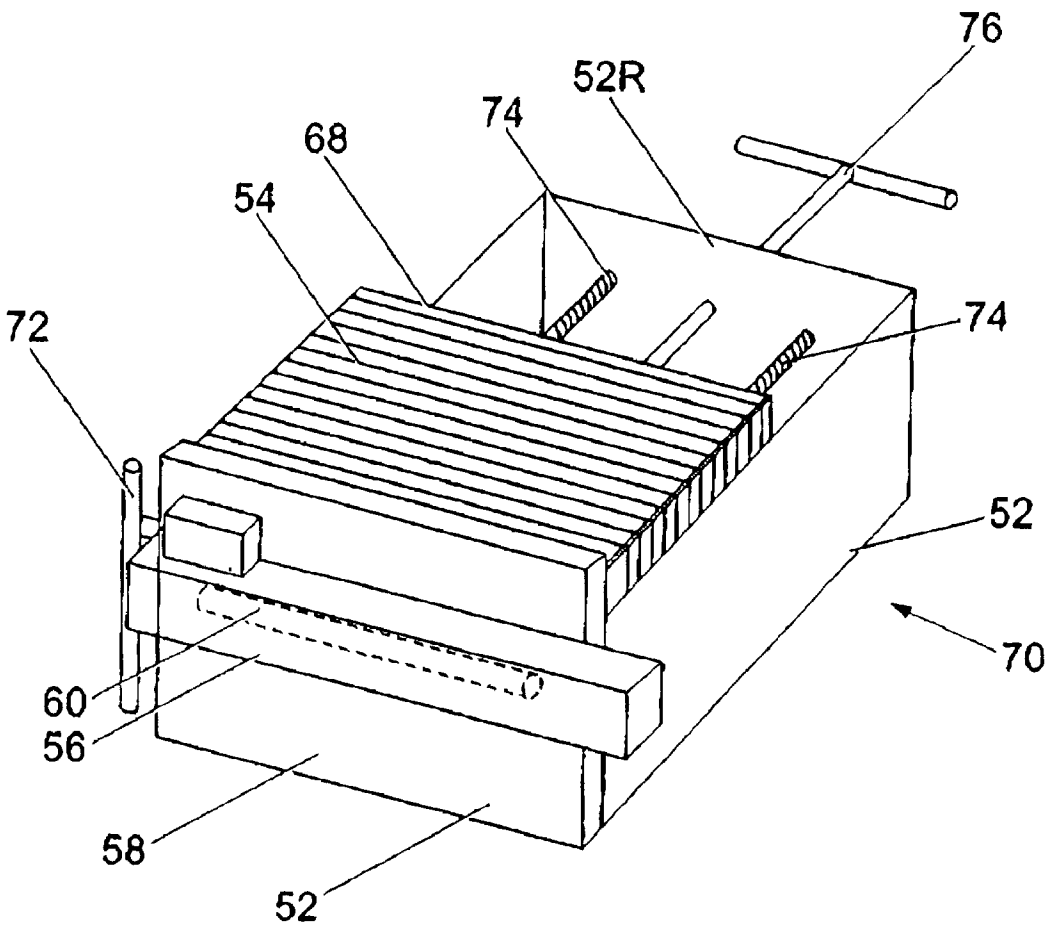
FIG. 6 is a second embodiment of a card insertion apparatus for use with the apparatus of FIGS. 1 to 4.

A second embodiment of a card insertion unit 70 is shown in FIG. 6, and also comprises a frame 52, stationary plate 58, rodless cylinder 56, where there is a slot 60 also formed in the stationary plate 58. However, it should be noted that the card insertion unit 70 comprises an optional envelope splitter mechanism 72 which is also coupled to the piston (not shown) of the rodless cylinder 56, such that when the rodless cylinder 56 is actuated, the envelope splitter 72 moves toward the envelopes which are travelling past the card insertion unit 70 and splits the batch of envelopes such that a card 54 can be inserted in between the split envelopes. However, it should be noted that the envelope splitter 72 is not required for use with the apparatus of FIGS. 1 and 2 since the apparatus of FIGS. 1 and 2 automatically splits the envelopes into suitably sized batches of e.g. 100 or 500 for instance.

The card insertion unit 70 exhibits an alternative method of urging the cards 54 toward the stationary plate 58, in that the backboard 68 is urged toward the stationary plate 58 by a pair of springs 74 which act between the frame 52R and the rear of the backboard 68. A handle 76 is also provided and is coupled to the rear surface of the backboard 68, such that additional cards 54 can be easily inserted into the frame 52 by an operator pulling upon handle 76 against the biasing action of the spring 74.

Figure 7:
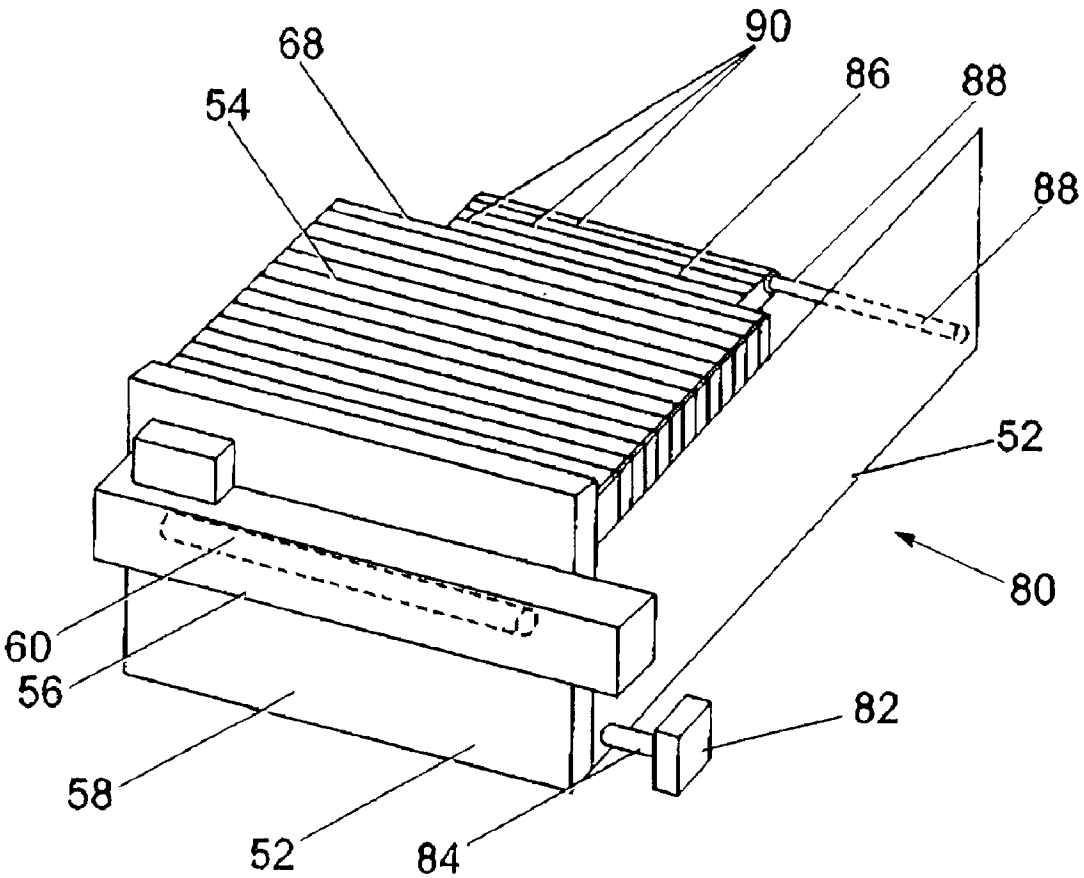
FIG. 7 is a third embodiment of a card insertion apparatus for use with the apparatus of FIGS. 1 to 4.

A third embodiment of a card insertion unit 80 is shown in FIG. 7 as comprising a frame 52 and similar rodless cylinder 56 which is actuated by the control system at a suitable point to move a card 54 into the path of travel of the envelopes. The cards 54 are urged toward the stationary plate 58 by means of a stepper motor 82, which is controlled by the control system to incrementally rotate a drive rod 84. The drive rod 84 is coupled to one end of a continuous belt 86, where the other end of the continuous belt 86 is supported by support rod which is itself coupled to a portion of the frame 52. The drive rod 84 is provided with a geared outer surface which engages with a gear provided on the inner surface of the belt 86. The outer surface of the belt 86 is provided with ridges 90, where a card is held and hence supported between two ridges 90.

The control system then instructs piston 1 to retract vertically downwardly, and also instructs piston 2 to retract from left to right to the return position as shown in FIG. 1.

The control system then actuates horizontally arranged piston 4 to move the envelope pick-up head 6 along track 36 from left to right as shown in FIG. 1 until the pick-up head 6 is located vertically above the envelope loading area 32. The control system then instructs vertically arranged piston 5 to extend the pick-up head 6 vertically downwardly until side-by-side and horizontally spaced apart arms 37 of the pick-up head 6 are located either side of the batch of envelopes. However, it should be noted that pistons 4 and 5 may be controlled by the control system to act as one in that they may be encoded pistons 4, 5. It should also noted that the machine 30 is arranged such that the control system instructs piston 5 to move the piston head 6 a predetermined height to an area just above the envelope loading area 32.

Another piston (not shown) associated with the head 6 is actuated by the control system to move the arms 37 toward one another such that the arms 37 grab the batch of envelopes. The control system then instructs piston 5 to lift the batch of envelopes a short distance above the envelope loading area 32, where this distance may typically be in the region of 5 mm. At the end of this short distance stroke of piston 5, the control system actuates piston 4 to move the head 6 and envelopes to a box loading area 38. Just prior to this point, the operator has placed a box 20 immediately below the loading area 38, where the box 20 is placed upon a series of rollers 39 for ease of movement.

Alternatively, an automated box 20 loading machine (not shown) can be provided for use with the machine 30 to automatically load the box 20 into the position shown in FIG. 1.

At the end of the stroke of piston 4, the control system triggers piston 5 to lower the head 6 and hence envelopes into the box 20 to a predetermined depth. It should be noted that this depth is pre-programmed by an operator into the control system to allow all envelope sizes to be deposited to the correct depth and to permit efficient changeover of different types of envelope sizes. It should also be noted that a rotary switch or push button can be provided to determine the drop depth of piston 5; that is a switch can be mounted upon support member 40 and can be vertically adjustable so that it can be engaged by a horizontally projecting rod mounted on piston 5 such that when the switch is triggered by the rod, piston 5 is automatically deactuated.

The control system is arranged such that the end of the stroke of piston 5 triggers the piston associated with the head 6 to move the arms 37 apart from one another, and hence the envelopes are released from the grip within the head 6.

A wiper bar (not shown) is also provided on the head 6, and an associated piston for the wiper bar is also provided such that when the arms 37 are moved apart from one another, the wiper bar is moved into engagement on top of the batch of envelopes and remains there whilst the piston 5 is retracted and hence the arms 37 are withdrawn from the box 20.

The box is shown in FIG. 1 with one of its end lids 24 lying horizontal, and with the lids 24 furthest edge being engaged by a moveable flapper 41. Thus, the moveable flapper 41 and lid 24 have provided a flat surface and effectively have acted as an extension to the envelope loading area 32.

Once the piston 5 has fully retracted to the position shown in FIG. 1, the control system actuates piston 8 to release the engagement between the moveable flapper 41 and the end lid 24. The control system then actuates box table piston 42 to move the box table 43 and an upstanding arm 44 associated therewith from right to left as shown in FIG. 1. The rollers 39 remain stationary with respect to the machine 30, and it should be noted that the upstanding arm 44 is moved upwardly by the control system to push the end lid 24 about its hinge. The upstanding arm 44 continues to move from right to left and thereby not only moves the end lid 24 to a closed position over the opening of the box 20, but also moves the box 20 from right to left.

At this point, the box has been fully loaded with envelopes.

The machine 30 is also provided with a box closure device 9 as shown in FIG. 3 and which is in accordance with the third aspect of the present invention. The box closure device 9 is secured to the machine 30 and comprises first 12, second 13 and third 14 arms. The first and second arms 12, 13 are splayed outwardly from one another away from the main support 9A of the device 9, and are also angled downwardly therefrom. The first and second arms 12, 13 are provided with a first contact edge 12A, 13A which is arranged to make contact with the outermost surfaces of the two side lids 22, 23. The curved nature of the contact surfaces 12A and 13A ensure that the side lids 22, 23 are moved about their respective hinges such that they take up a vertically upstanding configuration.

The first and second arms 12, 13 are also provided with second contact surfaces 12B, 13B such that when the box 20 is moved from right to left, the second contact surfaces 12B, 13B move the side lids 22, 23 from their vertically upstanding configuration to a horizontal and closed configuration.

However, prior to the side lids 22, 23 making contact with the two arms 12, 13, a third arm 14 makes contact with the end lid 21 and moves it into the closed box configuration .

Accordingly, the interaction between the third arm 14 and the upstanding arm 44 have closed the two end lids 21, 24 respectively, and the interaction between the first and second arms 12 and 13 have thereafter closed the two side lids 22, 23.

The control system continues to actuate the table piston 42 such that the box 20 continues to move right to left as shown in FIG. 1, until the box 20 passes underneath a taping machine which tapes the two edges of the side lids 22, 23 together. The box 20 continues to move right to left along a guided roller track 45, from which the box can be removed from the machine 30.

An alternative embodiment of portions of a machine 100 is shown in FIGS. 8 to 12. The machine 100 is broadly similar to machine 30, and the differences between them will be detailed below. As before, the envelopes (not shown) are conveyed from right to left by a conveyor (not shown) such that the envelopes arrive onto an envelope loading area 132, generally designated at 132, and generally in suitable batches of, e.g. 100 envelopes at a time.

Figure 8:
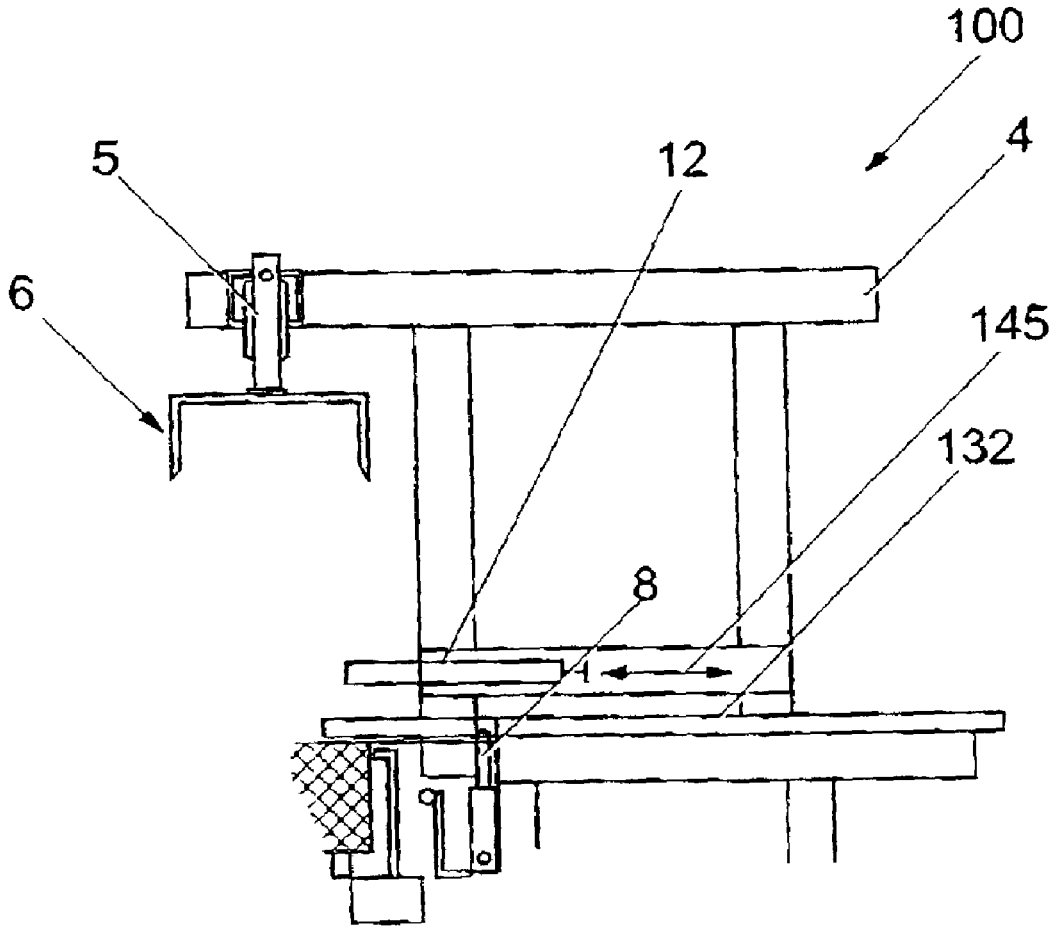
FIG. 8 is a front elevation of a portion of a second embodiment of an apparatus for handling items, box closure apparatus and an apparatus for observing envelopes in accordance with the first, third and fifth aspects of the present invention.
Figure 9:
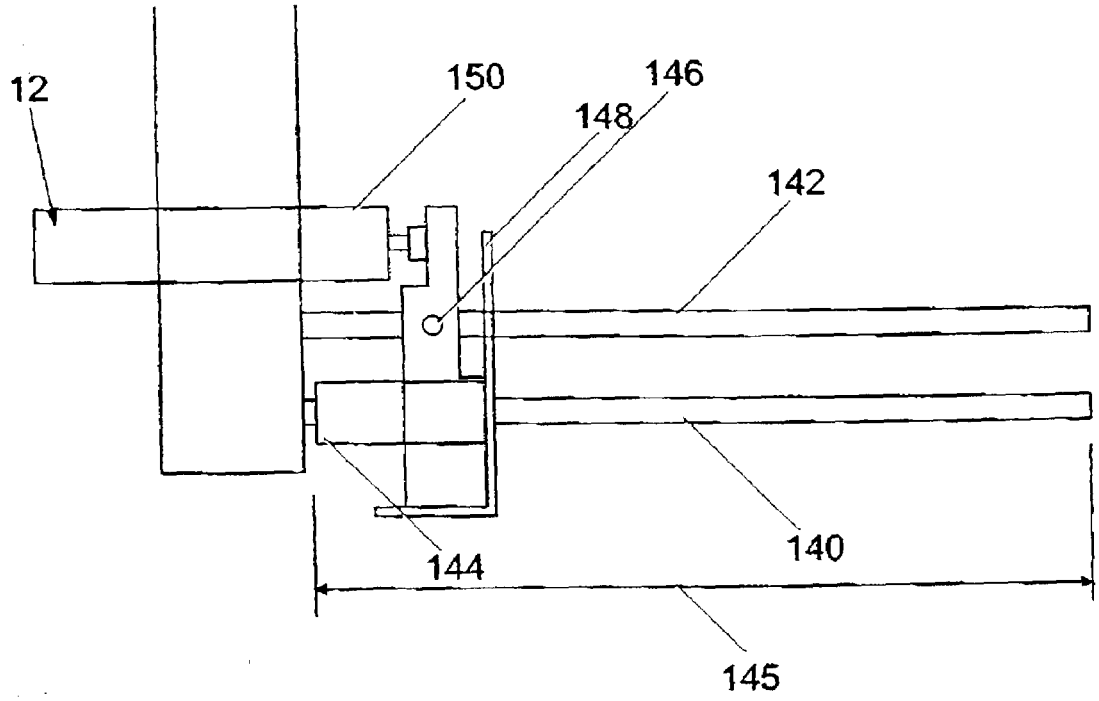
FIG. 9 is more detailed front elevation view of a portion of the apparatus of FIG. 8.
Figure 10:
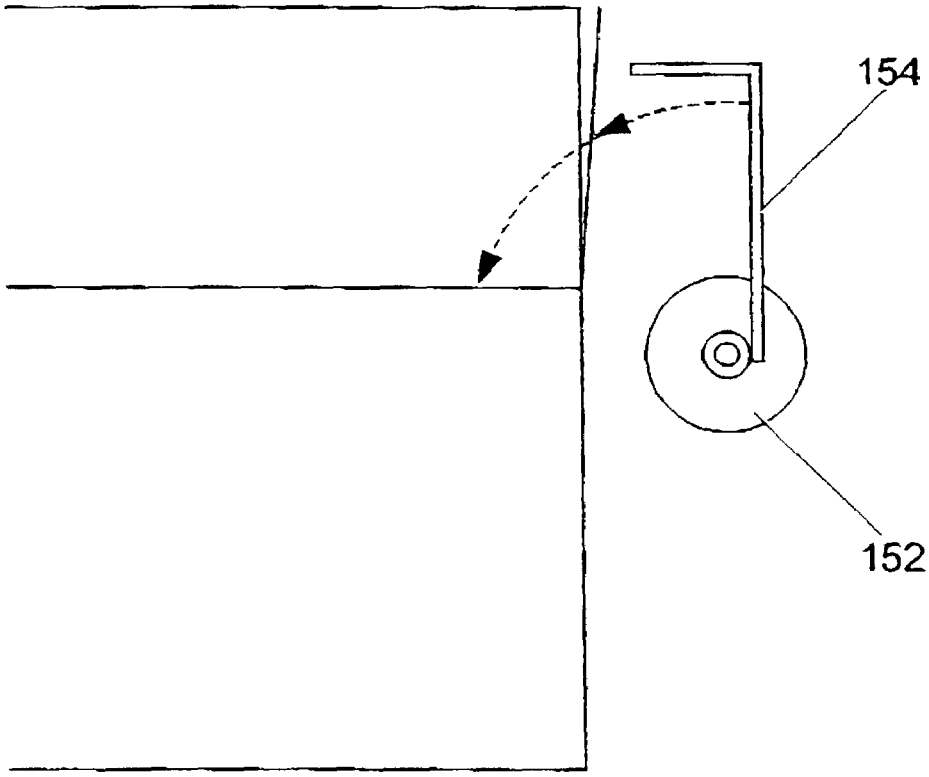
FIG. 10 is more detailed front elevation view of a portion of the apparatus of FIG. 8.

An envelope supporting apparatus generally designated at 12, is additionally provided for the apparatus 100, and is shown in greater detail in FIG. 9. The envelope supporting apparatus 12 comprises a horizontally arranged rail 140 located just above the envelope loading area, the rail 140 being arranged parallel to the path of travel of the batch of envelopes. A horizontally arranged nylon strip 142 is located vertically above the rail 140, and a carriage 144 is moveably mounted on the rail 140 and is coupled to the nylon strip 142 by means of a spring loaded ball 146, such that the spring loaded ball 146 can be adjusted to vary the biasing force applied to the nylon strip 142 in the perpendicular direction to the path of travel of the envelopes. A pair of vertically upstanding, and spaced apart, envelope support fingers 148 are provided on the front (right hand side) face of the carriage 144. A piston 150 is coupled to the carriage 144 such that the piston 150 can be actuated to move the carriage 144 in the direction, from left to right as shown in FIG. 8, along the path of travel of the envelopes.

Before the first batch of envelopes arrives at the envelope loading area 132, the piston 150 is actuated to move the carriage 144, from the position shown in FIG. 8, toward the arrival position of the envelopes; i.e. the piston strokes outwardly, from left to right in FIG. 8, along a carriage travel area 145.

The first batch of (for example 100) envelopes are moved toward the carriage 144 by the envelope divider 3 until they meet the envelope support fingers 148. The envelope divider is then withdrawn as previously described, and the envelopes are then held in place against the support fingers 148 by the action of the nylon strip being gently forced against the sides of the envelopes. The second batch of (for example 100) envelopes are moved toward the carriage 144 and the first batch by the envelope divider 3 until they meet the first batch, and when they do, the control system instructs the piston 2 to continue moving from left to right a distance substantially equal to the depth of the batch of the (for example 100) envelopes. The third batch of envelopes are then moved in a similar process, followed by fourth and fifth batches until a total of (for example 500) envelopes are arranged together on the envelope loading area.

Once the combined batch of (for example 500) envelopes have been removed from the envelope loading area the control signal generates a signal to instruct the piston 150 from the position shown in FIG. 8 to the position described above such that the carriage 144 is ready to accept the next first batch of envelopes, and the process described above is repeated.

The placement of the envelopes into the box 20 is substantially identical for the machine 100 as it was for the machine 30. Once the box 20 has been filled with envelopes to the desired level, and the box 20 is about to be pushed along the guided roller track 45 (which is the box closing area), a rotary actuator 152 is operated. The rotary actuator 152 is located at a suitable location on the machine, such as in the approximate location of, and instead of, the upstanding arm 44 of the machine 30. The rotary actuator 152 is provided with an 'L' shaped arm 154, and rotation of the rotary actuator 152 rotates the 'L' shaped arm 154, such that the distal end of the 'L' shaped arm 154 engages the rear lid of the box 20 and rotates it about it's hinge toward the closed position. The box 20 can then be manually pushed along the guided roller track 45, or can be automatically moved along the guided roller track 45 if the machine 100 is appropriately modified.

Figure 11:
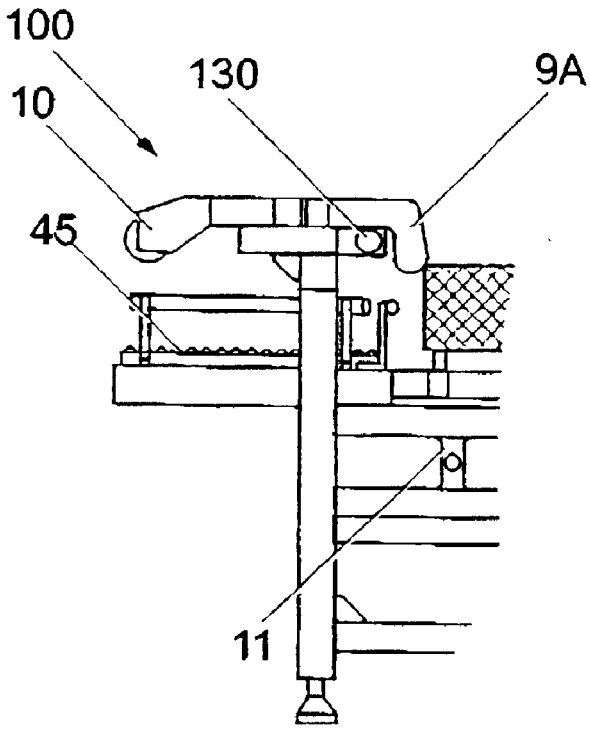
FIG. 11 is a front elevation of another portion of the second embodiment of an apparatus for handling items, box closure apparatus and an apparatus for observing envelopes in accordance with the first, third and fifth aspects of the present invention.
Figure 12:
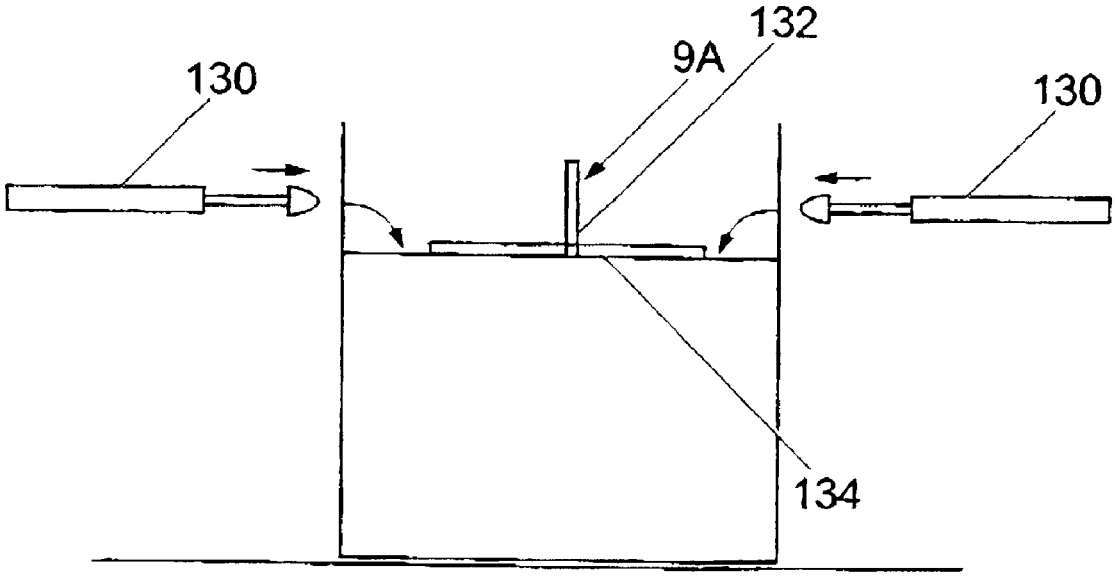
FIG. 12 is an end view of a more detailed view of a portion of the apparatus of FIG. 11.

The machine 100 also has a modified box closure device 9A, as shown in FIGS. 11 and 12, compared with the box closure device of the machine 30. The modified box closure device 9A comprises a vertical plate 132 and a horizontal flat plate 134 mounted at the lower end of the vertical plate 132. As the box 20 is moved along the guided roller track 45, the flat plate 134 and vertical plate 132 conspire to rotate the front end lid 21 of the box 20 about it's hinge coward the closed position, and the flat plate 134 maintains the front lid 21 in the closed position. One horizontally arranged piston 130 is arranged at each side of the box 20, and the pistons 130 are arranged to actuate, by means of the control system, and stroke inwardly toward the side lids 22, 23 of the box 20 from both sides of the box 20. In this manner, the side lids 22, 23 are rotated about their respective hinges toward the closed position, and lie on the upper surface of the flat plate 134. The box 20 is then passed underneath a taping machine, as before, which tapes the two edges of the side lids 22, 23 together. The box 20 continues to move right to left along a guided roller track 45, from which the box can be removed from the machine 100.

Modifications and improvements may be made to the embodiments without departing from the scope of the invention. For instance, other movement mechanisms could be provided instead of the various pistons, but the provision of the pistons provide the advantage that the control system can operate them in turn with ease. Additionally, the apparatus 30, 100 could be utilised for boxing objects other than envelopes, such as books, brochures etc. and other objects or items.

What is claimed is:

1. An apparatus for handling envelopes and thereafter placing the envelopes in a container, the apparatus comprising:

a conveyor defining a path along which the envelopes are delivered to a first portion of an envelope loading area to form a stack of envelopes;

a control system adapted to receive a signal from an envelope counter, wherein when a pre-determined number of envelopes have been delivered to the stack at the first portion of the envelope loading area, the control system actuates a combined envelope dividing and movement mechanism to firstly divide from the stack a number of envelopes which equals the predetermined number of envelopes and secondly moves, in the same direction of travel as that of the said path, the pre-determined number of envelopes toward a second portion of the envelope loading area located closer to the container;

a card insertion mechanism located to the side of, and just prior to, the second portion of the envelope loading area, the card insertion mechanism being capable of providing a card at each end of the pre-determined number of envelopes; and a grabbing member comprising at least two moveable grabbing arms, the arms being moveable from a first configuration to a second configuration, the arms being moved toward one another from the first configuration to the second configuration such that the arms are capable of grabbing the cards at each end of the pre-determined number of envelopes, the grabbing member having a movement mechanism associated therewith such that the grabbing member is capable of firstly grabbing the cards at each end of the predetermined number of envelopes, secondly lifting the said cards and envelopes, thirdly moving the cards and envelopes in the same direction of travel as that of the said path and fourthly lowering the cards and envelopes into the container.

2. Apparatus according to claim 1, wherein the container is a box.

3. Apparatus according to claim 1, wherein the movement mechanism is capable of moving the grabbing member in a horizontal plane.

4. Apparatus according to claim 1, wherein the movement mechanism is capable of moving the grabbing member in a vertical plane.

5. Apparatus according to claim 1, wherein the movement mechanism comprises a horizontal movement device and also comprises a vertical movement mechanism.

6. Apparatus according to claim 5, wherein the horizontal movement device comprises a horizontally arranged track, and a horizontal movement mechanism which acts between the track and the grabbing member.

7. Apparatus according to claim 6, wherein the horizontal movement mechanism comprises a piston which is operable by means of a control system.

8. Apparatus according to claim 6, wherein the vertical movement mechanism comprises a first portion and a second portion, the first and second portions being moveable relative to one another by means of a vertical movement device.

9. Apparatus according to claim 8, wherein the vertical movement device comprises a piston which acts, and is operable between, the first and second portions of the vertical movement mechanism.

10. Apparatus according to claim 9, wherein the first portion of the grabbing member is movably coupled to the track, and the second portion is coupled to the grabbing arms, such that the first and second portions are coupled to one another by means of the piston.

11. Apparatus according to claim 1, wherein the grabbing arms are moveable toward one another by means of an arm movement mechanism, wherein the arm movement mechanism is capable of moving the arms both toward and away from one another.

12. Apparatus according to claim 1, further comprising a box closure device, the box having at least two lid portions arranged on the box about an opening of the box, where the lid portions are coupled to the box by respective hinges and are capable of being moved about their respective hinges into a configuration such that the opening of the box is substantially closed, the apparatus comprising first and second members having respective contact surfaces, the respective contact surfaces being adapted to move the respective lid portions about their respective hinges into the said configuration upon relative movement between the first and second members and the box.

13. Apparatus according to claim 1, comprising a work station for observing the envelopes, the work station comprising a viewing means which is arranged to permit in the region of 180 degrees of viewing area of the envelopes to an operator, the operator being able to view in the region of the other 180 degrees of viewing area, such that the operator is provided with in the region of 360 degrees of viewing area of the items.

14. Apparatus according to claim 1, wherein the card insertion mechanism comprises a card movement mechanism which, when actuated, is adapted to move a card from a first location to a second location, and a biasing means which is capable of urging the card toward the first location.

15. Apparatus according to claim 14, wherein the card movement mechanism comprises a cylinder mechanism and a card grasping means.

16. Apparatus according to claim 14, wherein the card insertion apparatus further comprises a frame for at least temporarily storing the cards, and further comprises a stationary plate against which the cards are urged by the biasing means.

17. Apparatus according to claim 14, wherein the biasing means comprises a weight which is coupled to a moveable member, whereby the weight urges the moveable member in the direction toward the stationary plate, thereby urging the cards toward the stationary plate.

18. A method of handling envelopes and thereafter placing the envelopes in a container, the method comprising the steps of:

delivering the envelopes on a conveyor along a path to a first portion of an envelope loading area in order to form a stack of envelopes, providing a control system adapted to receive a signal from an envelope counter, wherein when a pre-determined number of envelopes have been delivered to the stack at the first portion of the envelope loading area, the control system actuates a combined envelope dividing and movement mechanism to firstly divide from the stack a number of envelopes which equals the predetermined number of envelopes and secondly move, in the same direction of travel as that of the said path, the pre-determined number of envelopes toward a second portion of the envelope loading area located closer to the container, such that a card insertion mechanism located to the side of, and just prior, to the second portion of the envelope loading area is capable of providing a card at each end of the pre-determined number of envelopes;

providing a grabbing member comprising at least two moveable grabbing arms;

moving the grabbing arms toward one another to grab the cards at each end of the pre-determined number of envelopes; and moving the grabbing member such that the grabbing member firstly lifts the cards and envelopes, secondly moves the cards and pre-determined number of envelopes from the second portion of the envelope loading area in the same direction of travel as that of the said path, and thirdly lowers the cards and envelopes into the container.

19. A method according to claim 18, further comprising the steps of closing a box, the box having at least two lid portions arranged on the box about an opening of the box, where the lid portions are coupled to the box by respective hinges and are capable of being moved about their respective hinges into a configuration such that the opening of the box is substantially closed, the method comprising providing first and second members having respective contact surfaces, and causing relative movement between the first and second members and the box, such that the respective contact surfaces move the respective lid portions about their respective hinges into the said configuration.

* * * * *